US009748622B2

(12) United States Patent
Buchauer et al.

(10) Patent No.: US 9,748,622 B2
(45) Date of Patent: Aug. 29, 2017

(54) TUNABLE HIGH FREQUENCY FILTER

(71) Applicant: KATHREIN-WERKE KG, Rosenheim (DE)

(72) Inventors: Ralf Buchauer, Kufstein (AT); Bernd Schöninger, Kufstein (AT); Wilhelm Weitzenberger, Simbach am Inn (DE); Armin Holzbauer, Kolbermoor (DE)

(73) Assignee: Kathrein-Werke KG, Rosenheim (DE)

( * ) Notice: Subject to any disclaimer, the term of this patent is extended or adjusted under 35 U.S.C. 154(b) by 148 days.

(21) Appl. No.: 14/438,725

(22) PCT Filed: Oct. 24, 2013

(86) PCT No.: PCT/EP2013/003226

§ 371 (c)(1),
(2) Date: Apr. 27, 2015

(87) PCT Pub. No.: WO2014/063829

PCT Pub. Date: May 1, 2014

(65) Prior Publication Data

US 2015/0288043 A1 Oct. 8, 2015

(30) Foreign Application Priority Data

Oct. 25, 2012 (DE) ..... 10 2012 020 979

(51) Int. Cl.
*H01P 1/205* (2006.01)
*H01P 7/04* (2006.01)
*H01P 1/20* (2006.01)

(52) U.S. Cl.
CPC ..... *H01P 1/2053* (2013.01); *H01P 1/20* (2013.01); *H01P 1/205* (2013.01); *H01P 7/04* (2013.01)

(58) Field of Classification Search
CPC ..... H01P 1/20; H01P 1/205; H01P 7/04
(Continued)

(56) References Cited

U.S. PATENT DOCUMENTS

| | | | |
|---|---|---|---|
| 4,380,747 | A | 4/1983 | Curtinot et al. |
| 6,407,651 | B1 | 6/2002 | Wulff et al. |
| 2012/0049982 | A1 | 3/2012 | Lee |

FOREIGN PATENT DOCUMENTS

| | | | |
|---|---|---|---|
| CN | 1355946 | A | 6/2002 |
| CN | 1441879 | A | 9/2003 |

(Continued)

OTHER PUBLICATIONS

English translation of the International Preliminary Report on Patentability mailed Apr. 30, 2015, issued in corresponding International Application No. PCT/EP2013/003226.

(Continued)

*Primary Examiner* — Benny Lee
*Assistant Examiner* — Hafizur Rahman
(74) *Attorney, Agent, or Firm* — Nixon & Vanderhye P.C.

(57) ABSTRACT

The invention relates to an improved tunable high frequency filter of coaxial construction, characterized, inter alia, by the following features: The high frequency filter comprises an outer conductor housing (24) having an inner conductor (10) and a housing cover (22); the resonator (1) comprises a tuning element (30) arranged opposite the inner conductor (10), which in the housing cover (22) is held position-adjustably in the axial position of the tuning element (30), at least indirectly, and which extends into the internal space of the resonator; the tuning element (30) comprises a dielectric material, or is formed from a dielectric material such that between the outer thread (32) and the inner thread (41), current transitions are avoided.

7 Claims, 1 Drawing Sheet

Figure 2:
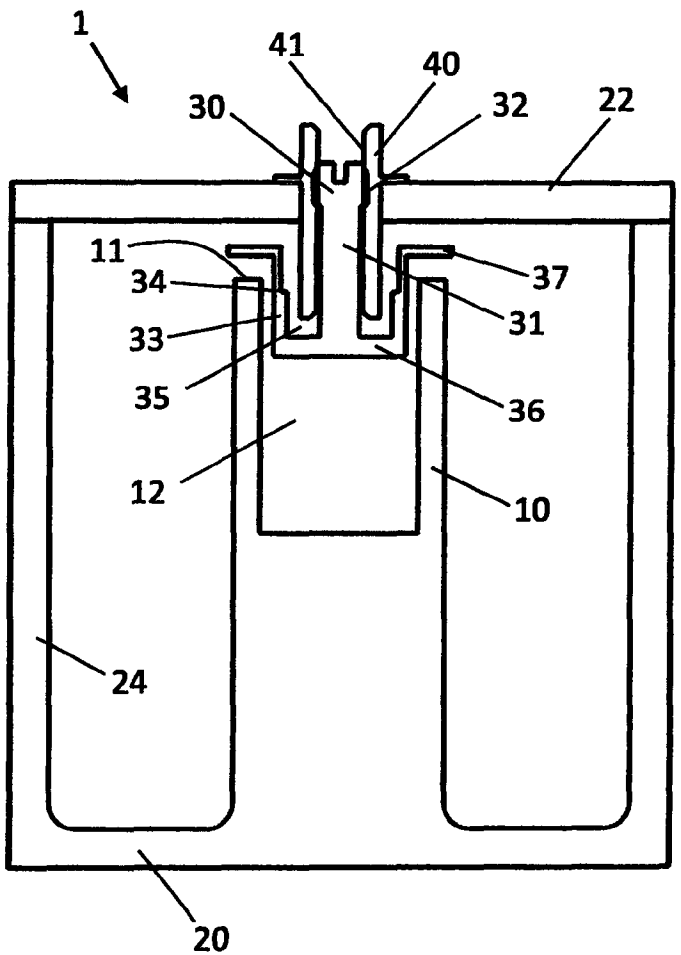

(58) Field of Classification Search
USPC ..... 333/207–209, 219, 227, 229
See application file for complete search history.

(56) References Cited

FOREIGN PATENT DOCUMENTS

| | | |
|---|---|---|
| CN | 102354780 A | 2/2012 |
| DE | 12 65 316 | 4/1968 |
| EP | 0 068 919 | 1/1983 |
| EP | 2 044 648 | 4/2009 |
| JP | 62-123801 | 6/1987 |
| WO | WO 00/64001 | 10/2000 |
| WO | WO 2006/058965 | 6/2006 |

OTHER PUBLICATIONS

International Search Report for PCT/EP2013/003226 mailed Dec. 19, 2013, 6 pages.
International Preliminary Report on Patentability for PCT/EP2013/003226 (foreign language) mailed Jan. 7, 2015, 36 pages.

TUNABLE HIGH FREQUENCY FILTER

This application is the U.S. national phase of International Application No. PCT/EP2013/003226 filed 24 Oct. 2013, which designated the U.S. and claims priority to DE Patent Application No. 10 2012 020 979.7 filed 25 Oct. 2012, the entire contents of each of which are hereby incorporated by reference.

The invention relates to a high-frequency filter of a coaxial construction in accordance with the preamble of claim 1.

In radio systems, in particular in the mobile radio field, a shared antenna is often used for transmitted and received signals. The transmitted and received signals each use different frequency ranges, and the antenna has to be suitable for transmitting and receiving in the two frequency ranges. Therefore, to separate the transmitted and received signals, suitable frequency filtering is required, by means of which on the one hand the transmitted signals are passed from the transmitter to the antenna and on the other hand the received signals are passed from the antenna to the receiver. Nowadays, high-frequency filters of a coaxial construction, inter alia, are used for splitting up the transmitted and received signals or for bringing together or separating mobile radio bands.

Two interconnected high-frequency filters form what is known as a duplex separating filter, which allows a largely decoupled combination of transmitters and receivers on a shared antenna. For example, a pair of high-frequency filters may be used, which both allow a particular frequency band (band-pass filters). Alternatively, a pair of high-frequency filters may be used, which both stop a particular frequency band (band-stop filters). Further, a pair of high-frequency filters may be used, of which one filter allows through frequencies below a frequency between the transmission and receiving band and stops frequencies above this frequency (deep-pass filter), and the other filter stops frequencies below a frequency between the transmission and receiving band and allows through frequencies above this frequency (high-pass filter). Further combinations of these filter types are also conceivable.

High-frequency filters are often constructed from coaxial resonators, since they consist of milled or cast parts, making them simple to manufacture. These resonators further ensure a high electrical quality and a relatively high temperature stability.

A conventional temperature-compensated coaxial resonator is known from WO 2006/058965 A1. In one embodiment, as well as a coaxial housing having a corresponding internal conductor which ends at a distance below the cover, it comprises an embodiment for setting the resonant frequency. For this purpose, as is conventional, a screw is used which can be screwed into or out of the cover by different distances. The control member is positioned axially orientated with respect to the internal conductor, and comprises a dielectric compensation element, in the form of a disc, on the end face thereof positioned facing the internal conductor.

An arrangement which is comparable in this regard is also known from JP 62123801 A.

EP 2 044 648 B1 discloses an example of a coaxial high-frequency filter. This filter comprises a resonator having an internal conductor and an external conductor, a tuning element comprising an external thread being provided in a housing cover of the resonator. A threaded recess comprising a thread is provided in the corresponding housing cover. The thread pitch of the external thread of the tuning element differs from the thread pitch of the internal thread of the threaded recess in at least one sub-portion of the internal thread and of the external thread, resulting in automatic self-locking of the tuning element. As a result of the thread error between the external thread and the internal thread, a maximum tension is set between the external thread of the threaded member and the internal thread of the threaded hole in the resonant filter housing at the axially remote thread portions, meaning that unambiguously reproducible electrical conditions are produced precisely at these locations as a result of the high contact forces, meaning that undesired intermodulation effects can be prevented. A drawback of this type of high-frequency filter is predominantly the critical contact transition from the external thread of the tuning element to the internal thread of the housing cover. As a result of metal wear between the tuning element and the housing cover, what are known as intermodulation products, in other words interfering frequencies, may form.

U.S. Pat. No. 4,380,747 discloses a further example of a coaxial high-frequency filter. The high-frequency filter disclosed in this document comprises a coaxial resonator which consists of an electrically conductive external conductor and an electrically conductive internal conductor. The external conductor and the internal conductor are interconnected via an electrically conductive base plate. The coaxial resonator is terminated by an electrically conductive cover. The frequency tuning is provided by way of a threaded pin, of which the penetration depth into the internal conductor is decisive as to frequency. When the frequency has been exactly set, the compensation threaded pin is fixed using a lock nut. A drawback of this type of coaxial resonator is the critical contact transition from the threaded pin to the cover. As a result of metal wear and undefined contact points between the threaded pin and the threaded hole, intermodulation products may form. A further drawback is the change in the tuned frequency during the locking process. This is caused by a minimal axial movement of the compensation pin when the lock nut is being actuated. This effect has a negative influence on the total compensation time, since a plurality of corrective compensation processes are required.

In all of the above-disclosed high-frequency filters, the tuning elements which are movably held in the housing cover consist of metal. The movement of the tuning elements is achieved in that the tuning elements comprise an external thread which is screwed into an internal thread of the housing cover. As a result, the threads are located in the high-frequency-critical resonator interior, inevitably resulting in intermodulation problems. Furthermore, resonator housings made of aluminium necessitate press-in threads for receiving the corresponding tuning element, since aluminium is too soft for fine threads, meaning that the thread of the adjustment element can seize. As mentioned previously, the tuning elements are arranged at high-frequency-critical points in the above-disclosed coaxial high-frequency filters, meaning that currents also flow via the contact region of the external thread of the tuning element and the internal thread of the resonator housing. In EP 2 044 648 B1, this problem is approached by way of tensioned threads. However, a corresponding coaxial high-frequency filter is complex to manufacture and is therefore expensive.

Further, high-frequency filters known from the prior art have insufficient frequency stabilisation in the event of a temperature change. If temperature fluctuations occur, there is a change in the mechanical length of the internal conductor tube. Since the mechanical length is inversely proportional to the frequency, the resonant frequency of the filter falls when the mechanical length increases with increasing temperature. For example, in a filter having a resonant frequency of 2.4 GHz, this effect can lead to a change in resonant frequency of 5.7 MHz for a temperature difference of 120° C.

In the event of temperature changes, a further, second effect occurs. At the free end of the internal conductor, a capacitor (known as a head capacitor) is formed between the cover and the internal conductor tube. This capacitor is also decisive as to frequency. If there is an increase in temperature, the internal conductor tube and the walls of the external conductor housing expand by the same factor. Since the walls of the external conductor housing are higher than the internal conductor tube, in other words have a greater axial length than the internal conductor tube, there is an increase in the distance between the internal conductor tube and the cover, resulting in a decrease in the head capacitance and in an increase in the resonant frequency. This effect thus counters the decrease in resonant frequency due to the greater mechanical length of the internal conductor tube in the event of temperature increases. However, this effect is smaller than the aforementioned resonant frequency reduction due to the expansion of the resonator, and so there is not sufficient temperature compensation.

So as to amplify the effect of the decrease in the head capacitance in the event of temperature increases, it is known from the prior art to produce parts of the internal conductor tube or of the internal conductor as a whole from a different material having a lower thermal conduction coefficient than the external conductor housing. As a result, in the event of a temperature increase, the head capacitance becomes even smaller, and compensates the effect of the increase in frequency due to the temperature-based length expansion. By means of filters of this type, temperature compensation can be achieved to the effect that the resonators in the filter have a constant resonant frequency in a particular temperature range. However, this type of compensation has some drawbacks. Because the internal conductor or parts of the internal conductor consist of a different material from the housing, an interference point always occurs between the two materials, even if the two are soldered together. Apart from manufacturing problems, this may also bring about intermodulation problems.

Further, a plurality of different materials have to be combined in the high-frequency-critical resonator space, mechanical tolerances in this space potentially having serious influences on the filter. For example, if an internal conductor is not placed precisely in the filter to within a few hundredths of a millimetre, the coupling bandwidth with respect to all of the adjacent resonators changes, and this in turn can lead to problems with the tuning.

U.S. Pat. No. 6,407,651 B1 discloses a high-frequency filter having a temperature compensation device. This high-frequency coaxial resonator comprises an external conductor housing having an internal conductor tube axially arranged thereon. The internal conductor tube ends at a distance below a cover which seals the external conductor housing. The internal conductor tube is provided with a longitudinal hole which passes through the internal conductor tube and into which a screw can be screwed from below. The screw can be screwed into a counter piece which has a peripheral rim at a distance from the free end of the internal conductor tube, in such a way that a bellows-shaped element can be inserted between this peripheral rim of the counter piece and the free end rim of the internal conductor tube. The screw has a thermal expansion coefficient which is lower than the thermal expansion coefficient of the internal conductor tube, which consists for example of aluminium. The bellows-shaped compensation element further consists of a different material from the material of the screw and of the internal conductor tube.

In the case of an increase in temperature, along with a corresponding increase in the axial length of the internal conductor tube, this compensation device ensures that the bellows-shaped compensation element is accordingly further compressed, since the overall construction consisting of the screw and the counter piece only changes length slightly by comparison. However, this embodiment also has various drawbacks, since additional elements are required, since the bellows-shaped element has to be welded on the peripheral end wall of the internal conductor tube etc. This may also lead to intermodulation problems.

Starting from the conventional prior art, the object of the present invention is therefore to produce an improved and simple possibility for tuning resonators, in other words individual resonators, high-frequency filters, frequency separating filters, band-pass filters, band-stop filters and the like, which can be produced more cost-effectively and does not have the above-described intermodulation problems and further has improved temperature compensation.

According to the invention, the object is achieved by a high-frequency filter according to claim 1. Advantageous embodiments of the invention are specified in the dependent claims.

In the high-frequency filter according to the invention, the tuning element comprises a dielectric material and/or is formed from a dielectric material. As a result, no intermodulation problems occur at the contact points of the tuning element with the housing cover or with a socket arranged between the housing cover and the tuning element, since the use of dielectric materials (plastics materials, ceramic etc.) for the tuning element prevents the occurrence of current transitions in metal thread regions. It is thus also possible for the tuning element to be operated from the housing cover side, in other words from the same side as additional compensation elements are also conventionally operated (for example for adjusting the coupling between resonators). Tuning via two sides of the high-frequency filter, in other words via the housing cover side and via the housing base side, is thereby avoided, without intermodulation problems occurring. It is further advantageous that in the high-frequency filter according to the invention the housing base does not comprise a compensation opening, meaning that additional sealing measures such as sealing films, sealing adhesions or environment covers in outdoor applications are dispensed with. It is further advantageous that the thermal length expansion of the tuning element, which consists of or comprises a dielectric material, in the high-frequency filter has a temperature-compensating effect, in other words frequency changes due to temperature can be greatly reduced. It should further be noted that a correspondingly formed tuning element can be produced particularly cost-effectively, since because of the material selection the tuning element can be produced very cost-effectively by injection moulding for example.

Preferably, the tuning element may comprise an external thread, and an internal thread may be arranged in the housing cover, in such a way that a movement or change in position of the tuning element can be brought about in a simple manner by twisting the tuning element. No intermodulation problems occur in this type of configuration either.

Preferably, the housing cover comprises a socket galvanically connected thereto, which extends in the direction of the housing base. In this case, the tuning element is movably held in an axial position in the socket.

The socket may be connected to the housing cover in a material fit. This may for example be achieved in that the housing cover is manufactured from a moulded part, the socket being an integral component of the moulded cover. Alternatively, the socket may also be a separate component which is connected to the housing cover. A connection of this type may for example be provided by pressing the socket into the housing cover or by soldering or welding the socket to the housing cover.

Preferably, the socket is in the form of a threaded socket comprising an internal thread and the tuning element comprises an external thread which is engaged with the internal thread of the threaded socket. As a result of an embodiment of this type, the axial movement of the tuning element is possible in a particularly simple and highly precise manner.

Preferably, the internal conductor comprises a longitudinal recess which extends from the face end of the internal conductor opposing the housing cover towards the housing base, the tuning element being introducible into the longitudinal recess in the internal conductor. As a result of a corresponding configuration of the high-frequency filter, the resonant frequency thereof can be adjusted particularly effectively.

Preferably, the socket ends at the level of the face end of the internal conductor or dips into the longitudinal recess in the internal conductor, the tuning element protruding out of the face end of the socket opposing the housing base. A corresponding embodiment of the high-frequency filter also makes it possible to adjust the resonant frequency of the high-frequency filter particularly effectively.

Preferably, the tuning element comprises a central portion by means of which the tuning element is movably held. In this case, an external thread is preferably attached to this central portion. The tuning element preferably further comprises a peripheral wall which is separated from the central portion by a recess of the central portion extending around the central portion, in such a way that a separating space is formed between the central portion and the peripheral wall. The central portion is connected to the peripheral wall via a tuning element base. The face end of the socket opposing the housing base can be received in the separating space between the central portion and the peripheral wall of the tuning element, in such a way that the peripheral wall is arranged between the socket and the internal conductor in the region of the longitudinal recess thereof. The tuning element is therefore bell-shaped and is upside-down-T-shaped in cross section.

As a result of a correspondingly formed high-frequency filter, the resonant frequency of the resonator can be adjusted particularly effectively. Further, the high-frequency filter configured in this manner has particularly good temperature compensation properties. Further, a high-frequency filter configured in this manner ensures an effective overvoltage protection, since the distance between the internal conductor tube in the region of the face end thereof and the face end of the socket facing the housing base is particularly small, meaning that in this region the maximum electrical field strength occurs at the "open" end of the internal conductor. At this location, there is an increased sparkover risk at higher transmission powers because of resonance effects. The peripheral wall of the tuning element is arranged between the internal conductor tube and the threaded socket, in such a way that the compensation element or the tuning element reliably protects against sparkovers because of the insulating effect thereof.

Preferably, the tuning element further comprises a collar, which extends around the tuning element, is connected to the face end of the peripheral wall opposing the housing cover, and extends radially away from the central portion. A high-frequency filter formed in this manner has a further increased sparkover protection at the open end of the internal conductor, since the collar bridges the face end of the internal conductor in such a way that a sparkover between the internal conductor and the housing cover inner face is reliably suppressed.

Preferably, the peripheral wall of the tuning element comprises a rim edge, so that the peripheral wall has a smaller wall thickness above the rim edge, in other words towards the housing cover, than below the rim edge, in other words towards the housing base. A high-frequency filter configured in this manner has further improved temperature compensation properties.

Preferably, the housing wall and the internal conductor consist of a first material, which has a first thermal expansion coefficient, or the housing wall consists of a first material, which has a first thermal expansion coefficient, and the internal conductor consists of a second material, which has a second thermal expansion coefficient. The tuning element consists of a third material, which has a third thermal expansion coefficient. The third thermal expansion coefficient of the third material is greater than the first thermal expansion coefficient of the first material and/or greater than the second thermal expansion coefficient of the second material.

In the event of a temperature increase, the tuning element expands more than the internal conductor and the housing wall in the axial direction of the tuning element, in such a way that a greater proportion of the peripheral wall above the rim edge is arranged between the internal conductor and the socket, meaning that there is less dielectric material between the internal conductor and the socket, decreasing the head capacitance of the resonator. Conversely, in the event of a temperature decrease, the tuning element contracts more than the internal conductor and the housing wall in the axial direction, in such a way that a smaller proportion of the peripheral wall above the rim edge is arranged between the internal conductor and the socket, meaning that there is more dielectric material between the internal conductor and the socket, increasing the head capacitance of the resonator.

As a result, the decrease in the head capacitance in the event of a temperature increase is amplified in the high-frequency filter formed in this manner, in such a way that because of the decrease in the head capacitance the accompanying increase in the resonant frequency turns out larger, resulting in a greater temperature compensation, since in the event of a temperature increase, the resonant frequency falls in parallel as a result of mechanical extension of the internal conductor tube. The same applies in reverse to the temperature compensation in the event of a decrease in temperature.

In a preferred embodiment of the invention, the height of the socket provided on the housing cover and comprising the internal thread has a dimension greater than or equal to 1.5 times the diameter of the socket. These values ensure in every case that no electromagnetic radiation can escape to the outside.

Figure 1:
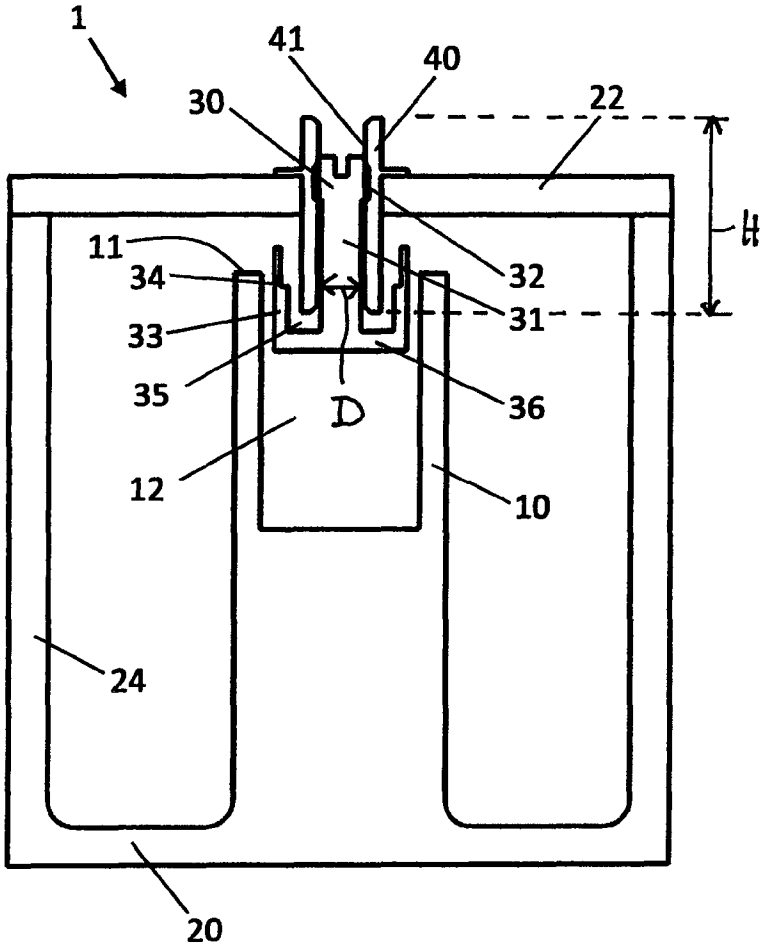

In the following, the invention is described in greater detail by way of drawings, in which, in detail:

FIG. 1 is a schematic axial cross section through a high-frequency filter according to the invention in accordance with a first embodiment of the present invention; and FIG. 2 is a schematic axial cross section through the high-frequency filter according to the invention in accordance with a second embodiment of the present invention.

In the following description, like reference numerals denote like components or like features, in such a way that a description made once for one component in reference to one drawing also applies to the remaining drawings, avoiding a repeated description.

FIG. 1 shows a high-frequency filter according to the invention, which comprises a resonator 1. However, the high-frequency filter may also comprise a plurality of resonators 1 coupled together. Each resonator 1 comprises an internal conductor 10 and an external conductor housing, which in turn comprises a housing base 20, a housing cover 22 spaced apart from the housing base 20, and a housing wall 24 extending around between the housing base 20 and the housing cover 22. It can be seen from FIG. 1 that the internal conductor 10 is integrally formed with the housing base 20 and the housing wall 24. The housing cover 22 is positioned on the free ends of the housing wall 24, and can for example be mechanically connected to the end faces of the housing wall by means of screws (not shown). However, it is also possible for the housing cover 22 to be integrally formed with the housing wall. A free end 11 of the internal conductor 10, which forms the end face of the internal conductor 10, is at a predetermined distance from the inner face of the housing cover 22.

It can be seen from FIG. 1 that the internal conductor 10 comprises a longitudinal recess 12, which extends from the face end of the internal conductor 10 opposing the housing cover 22 towards the housing base 20. In the resonators 1 shown in FIGS. 1 and 2, the internal conductors 10 are formed as internal conductor tubes 10 or as internal conductor cylinders 10.

It can be seen from FIGS. 1 and 2 that the high-frequency filter further comprises a socket 40, which in the embodiments shown is configured as a threaded socket 40 having an internal thread 41. The threaded socket 40 is galvanically connected to the housing cover 22. The threaded socket 40 may therefore consist of a metal or may consist of a dielectric material which is coated with a metal layer. The same applies to the housing cover 22, which is either formed from a metal or else coated with metal. The socket 40 may also be integrally formed with the housing cover 22, in such a way that the socket 40 is connected to the housing cover 22 in a material fit. It is further possible for the threaded socket 40 to be connected to the housing cover 22 for example by pressing in. However, the threaded socket 40 may also be galvanically connected to the housing cover 22 by soldering or welding.

The threaded socket 40 dips into the longitudinal recess 12 in the internal conductor 10. However, it is also possible for the threaded socket 40 to end at the level of the face end 11 of the internal conductor 10. It is also possible for the threaded socket 40 to end above the face end 11 of the internal conductor 10. The threaded socket 40 shown in FIGS. 1 and 2 also extends outside the resonator interior, in such a way that the housing wall of the threaded socket 40 extends outwards past the housing cover 22.

The high-frequency filter according to the invention further comprises a tuning element 30, which is movably held in the axial location thereof in the socket 40. For this purpose, the tuning element 30 comprises an external thread 32 on a central portion 31. The external thread 32 is engaged with the internal thread 41 of the threaded socket 40, in such a way that the axial location of the tuning element 30 can be changed by twisting said element. The tuning element 30 further comprises a peripheral wall 33, which is separated from the central potion 31 by a recess 35 extending around the central portion 31. A separating space 35 is thus formed between the central portion 31 and the peripheral wall 33. The central portion 31 is connected to the peripheral wall 33 via a tuning element base 36.

The face end of the threaded socket 40 opposing the housing base 20 is received in the separating space 35 between the central portion 31 and the peripheral wall 33 of the tuning element 30. The peripheral wall 33 is thus arranged between the socket 40 and the wall of the internal conductor tube 10. By screwing the tuning element 30 into and out of the resonator interior, the extent to which the peripheral wall 33 is arranged between the threaded socket 40 and the internal conductor 10 can thus be adjusted, in such a way that the head capacitance of the resonator 1 can thus be adjusted. The tuning element 30 preferably consists of a plastics material, in other words of a dielectric. The more material of the peripheral wall 33 that is arranged between the wall of the threaded socket 40 and the wall of the internal conductor 10, the greater the head capacitance of the resonator 1 becomes. As a result, the head capacitance of the resonator can be increased by screwing the tuning element 30 into the longitudinal recess 12 of the internal conductor 10. As a result screwing the tuning element 30 out of the longitudinal recess 12 in the internal conductor 10, there is less dielectric material between the threaded socket 40 and the internal conductor 10, decreasing the head capacitance of the resonator.

Since the tuning element 30 is formed from a dielectric material or from a dielectric, such as a plastics material, no intermodulation problems occur at the contact point of the external thread 32 with the internal thread 41. Screwing the tuning element 30 into the threaded socket 40 does not result in any metal wear which could lead to intermodulation problems.

Since, in other words, the tuning element 30 may for example consist as a whole of a dielectric material such as plastics material, in other words including the external thread 32, there can be no current transmission to the socket which, along with the associated internal thread 41, consists of an electrically conductive material. So as to prevent current transmission of this type, it is basically sufficient, for example, for the outer surface region of the tuning element 30 to consist of a dielectric material, in such a way that the threads as a whole are formed of a dielectric material, in such a way that no current transmission can take place via the internal thread, formed of metal or coated with a metal layer, of the socket 40. Thus, in this case, the axial core could also consist of metal in a smaller diameter than the external diameter of the tuning element 30, since this metal cannot come into contact with the surface of the internal thread 32 of the threaded socket 40 anywhere. Otherwise, it is noted as a basic principle that ultimately not only the tuning element 30, but also the threaded socket, may thus consist in whole or in part of a dielectric material, since a thread-thread engagement with an external thread 32 of the tuning element 30 and an internal thread 41 of the threaded socket 40, each made of dielectric material, likewise results in no current transmission being able to take place in the region of the thread-thread engagement.

The peripheral wall 33, which is arranged between the internal conductor 10 and the threaded socket 40, is an overvoltage protector for the resonator 1. In the coaxial resonator 1, the maximum field strength occurs at the open end 11 of the internal conductor 10. At high transmission powers, the risk of sparkover from the internal conductor 10 to the threaded socket 40 increases. This risk of sparkover is greatly reduced by the peripheral wall 33 of the tuning element 30.

It can be seen from FIGS. 1 and 2 that the peripheral wall 33 of the tuning element 30 comprises what is known as a rim edge 34. The wall thickness of the peripheral wall 33 is smaller above the rim edge 34 than the wall thickness of the peripheral wall below the rim edge 34. In the embodiments shown, the edge 34 faces the threaded socket 40. However, it is also possible for this edge 34 to face the internal wall of the internal conductor 10.

FIG. 2 shows a high-frequency filter in accordance with the second embodiment of the present invention. The construction of the high-frequency filter shown in FIG. 2 is identical to the high-frequency filter shown in FIG. 1, the sole difference being that the tuning element 30 further comprises a peripheral collar 37 which is connected to the face end of the peripheral wall 33 opposing the housing cover 22 and which extends radially away from the central portion 31. This collar 37 results in a further reduction in the sparkover risk, since the collar 37 is positioned above the free end 11 of the internal conductor 10, in such a way that the collar 37 is arranged between the free end 11 and the internal wall of the housing cover 22. Thus, a sparkover between the internal conductor 10 and the housing cover 22 is also reliably suppressed.

The housing base 20, the housing wall 24 and the internal conductor 10 conventionally consist of a metal, in other words of a first material, which has a first thermal expansion coefficient. It is also possible for the housing wall 24 to consist of a first material, which has a first thermal expansion coefficient, and for the internal conductor 10 to consist of a second material, which has a second thermal expansion coefficient. As stated previously above, the tuning element may for example consist of a plastics material, in other words of a third material, which has a third thermal expansion coefficient. The third thermal expansion coefficient of the plastics material is greater than the first thermal expansion coefficient of the first material and/or greater than the second thermal expansion coefficient of the second material. In the event of a temperature increase, this results in the tuning element 30 expanding more than the internal conductor 10 and the housing wall 24, in such a way that a greater proportion of the peripheral wall 33 above the rim edge 34 is located between the internal conductor 10 and the socket 40. As a result, there is less dielectric material, from which the tuning element 30 is formed, between the internal conductor 10 and the socket 40, thus decreasing the head capacitance of the resonator 1.

In turn, in the event of a decrease in temperature, the tuning element contracts more than the internal conductor 10 and the housing wall 24 in the axial direction, meaning that a smaller proportion of the peripheral wall above the rim edge is located between the internal conductor 10 and the socket 40, and this in turn means that there is more dielectric material between the internal conductor 10 and the socket 40. This increases the head capacitance of the resonator.

In the above-disclosed high-frequency filter, the external conductor housing may for example consist of aluminium, brass, Invar steel, cast aluminium or Arnite plastics material comprising glass fibres. The housing cover 22 may also be formed from the same materials. Likewise, the housing along with the internal conductor, the housing base and the housing cover may consist of a dielectric material, which is coated with an electrically conductive layer. Usually, the electrically conductive layer is applied to the cover on the inner face, in such a way that full-area galvanic contact is ensured at the connection point between the housing cover and the peripheral housing walls of the external conductor housing. This electrically conductive layer may also be provided in the region of the socket 40 and thus also cover the internal thread 41 of the threaded socket 40, in such a way that the internal thread is in turn electrically conductive on the surface thereof. The tuning element may for example be formed from acrylonitrile butadiene styrene (ABS plastics material). The internal conductor may be formed from the same materials as the external conductor housing.

In the embodiment shown, it is shown that the threaded socket 40 may optionally also be attached passing through the housing cover at a different height. It has been found to be advantageous for the height H, in other words the axial length H of the threaded socket 40, to be of a dimension ≥1.5 times the internal diameter D of the threaded socket 40, preferably ≥1.6, 1.7, 1.8, 1.9, 2.0 or even 2.25, 2.5, 2.75, 3.0 and/or more. In general, however, it is sufficient for these values to be no greater than 2.0 or 2.5 or else 3.0. In all these cases, it is ensured that the housing as a whole is optimally shielded from the outside, and no electromagnetic radiation can enter or exit.

The invention claimed is:

1. High-frequency filter of a coaxial construction, the high-frequency filter comprising:

at least one resonator having an internal conductor and an external conductor housing;

the external conductor housing comprising a housing base, a housing cover spaced apart from the housing base, and a housing wall extending around between the housing base and the housing cover;

the internal conductor being galvanically connected to the housing base and extending in an axial direction from the housing base towards the housing cover;

the internal conductor ending at a distance from the housing cover and/or being galvanically separated from the housing cover;

the resonator comprising a tuning element, which is arranged opposing the internal conductor, and which is movably held in an axial location thereof in the housing cover, at least indirectly, and protrudes into a resonator interior, the tuning element having an external thread;

the internal conductor comprising a longitudinal recess, which extends from a face end of the internal conductor opposing the housing cover towards the housing base;

the tuning element structured to be introduced into the longitudinal recess of the internal conductor;

an internal thread formed in one of (a) the housing cover or (b) in a socket which is provided in the housing cover and also connected in the housing cover;

the tuning element having the external thread being rotatably arranged in said internal thread;

the tuning element being formed from a dielectric material in such a way that current transitions are prevented between the external thread and the internal thread;

the tuning element comprising a central portion, by which the tuning element is movably held, the tuning element further comprising a peripheral wall, the tuning element and the peripheral wall being separated from one another by a recess extending around the central portion, in such a way that a separating space is formed between the central portion and the peripheral wall, the central portion and the peripheral wall being interconnected via a tuning element base; and a face end of the socket opposing the housing base being receivable in the separating space between the central portion and the peripheral wall of the tuning element or dipping into said separating space, in such a way that the peripheral wall is arranged between the socket and the internal conductor in the region of the longitudinal recess thereof;

wherein the tuning element further comprises a collar, which extends around the tuning element, is connected to the face end of the peripheral wall opposing the housing cover, and extends radially away from the central portion.

2. High-frequency filter according to claim 1, wherein:

the housing cover comprises the socket, which is galvanically connected to the housing cover and which extends towards the housing base.

3. High-frequency filter according to claim 1, wherein:

the socket has a distal portion which is disposed at the level of the face end of the internal conductor or dips into the longitudinal recess of the internal conductor; and the tuning element protrudes out of the face end of the socket opposing the housing base and thus dips even further into the longitudinal recess of the internal conductor.

4. High-frequency filter according to claim 1, wherein the peripheral wall of the tuning element comprises a rim edge, in such a way that the peripheral wall above the rim edge has a smaller wall thickness than below the rim edge.

5. High-frequency filter according to claim 1, wherein the ratio between an axial height or length (H) of the socket and a diameter (D) of the socket has a value of ≥1.6, 1.7, 1.8, 1.9, 2.0, 2.25, 2.5, 2.75 and/or 3.0.

6. High-frequency filter according to claim 1, wherein:

the housing wall and the internal conductor consist of a first material, which has a first thermal expansion coefficient, or the housing wall consists of a first material, which has a first thermal expansion coefficient, and the internal conductor consists of a second material, which has a second thermal expansion coefficient;

the tuning element consists of a third material, which has a third thermal expansion coefficient; and the third thermal expansion coefficient of the third material is greater than the first thermal expansion coefficient of the first material and/or greater than the second thermal expansion coefficient of the second material.

7. High-frequency filter according to claim 6, wherein:

in the event of an increase in temperature, the tuning element expands more than the internal conductor and the housing wall in the axial direction of said tuning element, in such a way that a greater proportion of the peripheral wall above the rim edge is arranged between the internal conductor and the socket, providing less dielectric material between the internal conductor and the socket, thus decreasing a head capacitance of the resonator; and in the event of a decrease in temperature, the tuning element contracts more than the internal conductor and the housing wall in the axial direction, in such a way that a smaller proportion of the peripheral wall above the rim edge is arranged between the internal conductor and the socket, providing more dielectric material between the internal conductor and the socket, thus increasing a head capacitance of the resonator.

* * * * *